US007517242B2

(12) United States Patent
Brodersen et al.

(10) Patent No.: US 7,517,242 B2
(45) Date of Patent: Apr. 14, 2009

(54) CLAMPING DEVICE FOR POWER CABLES

(75) Inventors: Peter Brodersen, Hamburg (DE); Henning Doll, Hamburg (DE); Wilhelm Niemann, Norderstedt (DE)

(73) Assignee: Yxlon International X-Ray GmbH, Hamburg (DE)

( * ) Notice: Subject to any disclaimer, the term of this patent is extended or adjusted under 35 U.S.C. 154(b) by 528 days.

(21) Appl. No.: 11/246,513

(22) Filed: Oct. 7, 2005

(65) Prior Publication Data

US 2006/0084315 A1 Apr. 20, 2006

(30) Foreign Application Priority Data

Oct. 8, 2004 (DE) ..... 10 2004 049 226

(51) Int. Cl.
*H01R 3/00* (2006.01)

(52) U.S. Cl. ..... 439/488; 439/700; 439/921

(58) Field of Classification Search ..... 439/319, 439/362, 382, 488, 489, 700, 884, 921
See application file for complete search history.

(56) References Cited

U.S. PATENT DOCUMENTS 4,266,841 A 5/1981 Sherwood et al.
4,978,309 A * 12/1990 Straub ..... 439/126
6,556,654 B1 4/2003 Hansen et al.

FOREIGN PATENT DOCUMENTS

DE 1981 31 10 660 A1 9/1982
DE 44 25 421 C1 2/1996
EP 0 060 930 9/1982

OTHER PUBLICATIONS

EPO Search Report dated Jun. 7, 2006.

* cited by examiner

*Primary Examiner*—Khiem Nguyen
(74) *Attorney, Agent, or Firm*—Graybeal Jackson LLP

(57) ABSTRACT

The invention relates to a clamping device for power cables with an essentially tubular bell housing in which a tubular holding element for a power cable is arranged mobile along the central longitudinal axis of the bell housing, and with a spring which is arranged between a stop in the bell housing and the holding element and pushes the holding element away from the stop along the central longitudinal axis, a display element being arranged at the holding element, so that the tension of the spring can be learned from outside, and the spring surrounds the power cable.

10 Claims, 4 Drawing Sheets

CLAMPING DEVICE FOR POWER CABLES

CROSS-REFERENCE TO RELATED APPLICATION

Priority is claimed under 35 USC §119(a) to German Patent Application No. 10 2004 049 226.3, filed 8 Oct. 2004, which application is incorporated herein by reference.

BACKGROUND OF INVENTION

The invention relates to a clamping device for power cables which serves to connect a power cable to an X-ray tube or to high-voltage equipment.

As a rule, with known power cables which are used in X-ray units, resetting is repeatedly required after the first insertion into the corresponding cone of an X-ray tube or of a generator. This is because the contact pressure exerted on the rubber cone used as connection element eases because of the change in the mechanical properties of the rubber cone. The natural rubber used for the rubber cone settles over time, and surplus quantities of silicone on the so-called junction are expelled. When there is no longer a form-locking fit of the rubber cone to the insulator, high-voltage spark-overs, which can lead to the destruction of the power cable and of the X-ray tube or of the generator, occur inside the junction. The pressure path can be monitored only by opening the connection, which leads to a very high maintenance outlay, in particular also because of the necessary shutdown of the whole X-ray unit during this time.

Maintenance-free fixed connections between the power cable and a mating connector have therefore been proposed. The rubber cone of the power cable is vulcanized into the mating connector of the tube and set under extremely high pressure. However, a disadvantage of this is that the X-ray tube and the power cable form a unit which must be replaced together when servicing takes place, which means higher logistical and storage costs. This is the case in particular when different cable lengths are required.

In addition it is known from U.S. Pat. No. 6,556,654 B1 to provide a low-maintenance bent power cable with a pressure spring which is integrated into the cable flange. In the area of the pressure spring, a mechanical pointer is fitted which makes it possible, by reading off a position—which corresponds to the spring excursion—to verify the status of the quality of the high-voltage connection without opening the connection. Such a solution does not work, however, for the standard cables used in the industrial X-ray field.

SUMMARY OF THE INVENTION

The object of the invention is therefore to minimize the outlay when installing a power cable, ensure monitoring of the condition of the cable without opening the connection and keep the maintenance intervals very long.

The object is achieved by a clamping device for power cables—hereafter this will be simply called a clamping device—with the features of claim 1. By means of such a clamping device a power cable which can be connected thereto is pressed firmly into the insulator of an X-ray tube or generator because of the spring. Through the display element at the holding element, which can be connected to the power cable, the tension of the spring can be read off from outside. Because the spring surrounds the power cable and the position of the display element when placing the power cable in the insulator is known, the chronology of the change in the position of the spring can be learnt from outside via the display element. Thus it is not necessary to open the connections between power cable and insulator for the purposes of inspection. A resetting of the connections is necessary only when the display element has passed a certain position below which the contact pressure of the spring sinks below a predeterminable value and thus the rubber cone of the power cable is no longer pressed in a form-locking manner in the insulator. Thus a resetting of the connection is necessary only after a long period. The time can be determined immediately in a very simple manner using the display element. Thus not only is the maintenance interval increased, but a reliable reading is also obtained, which prevents damage to the power cable or to the X-ray tube or the generator.

An advantageous development of the invention provides that the display element is at least one headless screw, which in each case lies in an opening of the bell housing running parallel to the central longitudinal axis of the bell housing. This represents a very simple type of display which can be viewed from outside. In addition a first and a second stop for the display element are developed through the opening. When establishing the connection this connection can be set such that the display element stands by the first stop and over time moves in the direction of the second stop if the connection is automatically reset by the spring. For example the clamping device can be developed such that the connection must be reset as soon as the display element has reached the second stop. This is then a signal for the technician servicing the machine. In turn an optimization of the maintenance intervals can thus be ensured, while at the same time ensuring that the unit is not destroyed or damaged.

Another advantageous development of the invention provides that the display element is an electric, magnetic or pressure sensor which records the position of the holding element inside the bell housing. These different sensors make different application fields possible, so that the connection can be even better monitored. Monitoring is thus then not only possible by optical checks based on the position of the display element, but the signals of the sensors, regularly present in electrical form, can for example be displayed on a screen. Monitoring is then very well possible, the display even being able to take place outside any radiation protection box present around the X-ray tube. Monitoring of the connection is thus possible even during operation of the X-ray tube, so that the connection no longer needs to be approached directly in order to be able to carry this out.

Another advantageous development of the invention provides that the pressure sensor is integrated in the holding element and is arranged at the surface which is in contact with the spring. The pressure which the spring exerts on the holding element is thereby established in a very simple way. As the holding element can be fixedly connected to the power cable, this pressure also reproduces the pressure with which the rubber cone of the power cable is pressed into the insulator of the X-ray tube or of the generator. As soon as the pressure falls below a predeterminable value, this is a signal to reset the connection in order that no high-voltage spark-overs can occur at the junction.

Another advantageous development of the invention provides that the display element cooperates with a safety switch or a distance-measurement device. The result of using a distance-measurement device is that the connection has to be reset when a certain predeterminable value of a distance is not reached or is exceeded—depending on where the distance-measurement device is installed in relation to the direction of movement of the display element over time. By using a safety switch it is even possible, when a predeterminable value is reached, to turn off the generator automatically. This prevents a necessary resetting of the connection from being overlooked, so that it is ensured without fail that, given proper installation, no high-voltage spark-overs can occur at the junction.

Another advantageous development of the invention provides that the holding element has fixing means for the fixed releasable securing of the power cable. It is thereby possible to remove the power cable from the clamping device if it is defective. This avoids the need to also dispose of a still intact clamping device in such a case. Moreover, depending on the application, power cables of different lengths can be used in the same clamping device, so that a modular system is obtained. Overall this leads to a cost saving.

Another advantageous development of the invention provides that the fixing means are developed as a threaded bushing with an internal thread. It is thereby possible to screw a power cable which also has securing means in the form of an external thread to the fixing means of the holding element. This represents a very simple releasable connection, whose distance along the central longitudinal axis of the bell housing can also be varied. This affords greater flexibility when fitting and setting the connection.

Another advantageous development of the invention provides that, on the connection side, the bell housing has a circumferential flange in which there are at least two screw holes parallel to the central longitudinal axis of the bell housing. This provides a very simple possibility of pressing the power cable into the insulator by tightening the screws. This makes such a connection easy to loosen and reset again.

BRIEF DESCRIPTION OF THE DRAWINGS

Other advantages and details of the invention are described in the following with reference to the embodiments represented in the figures. In particular.

DESCRIPTION OF THE PREFERRED EMBODIMENTS

Figure 1:
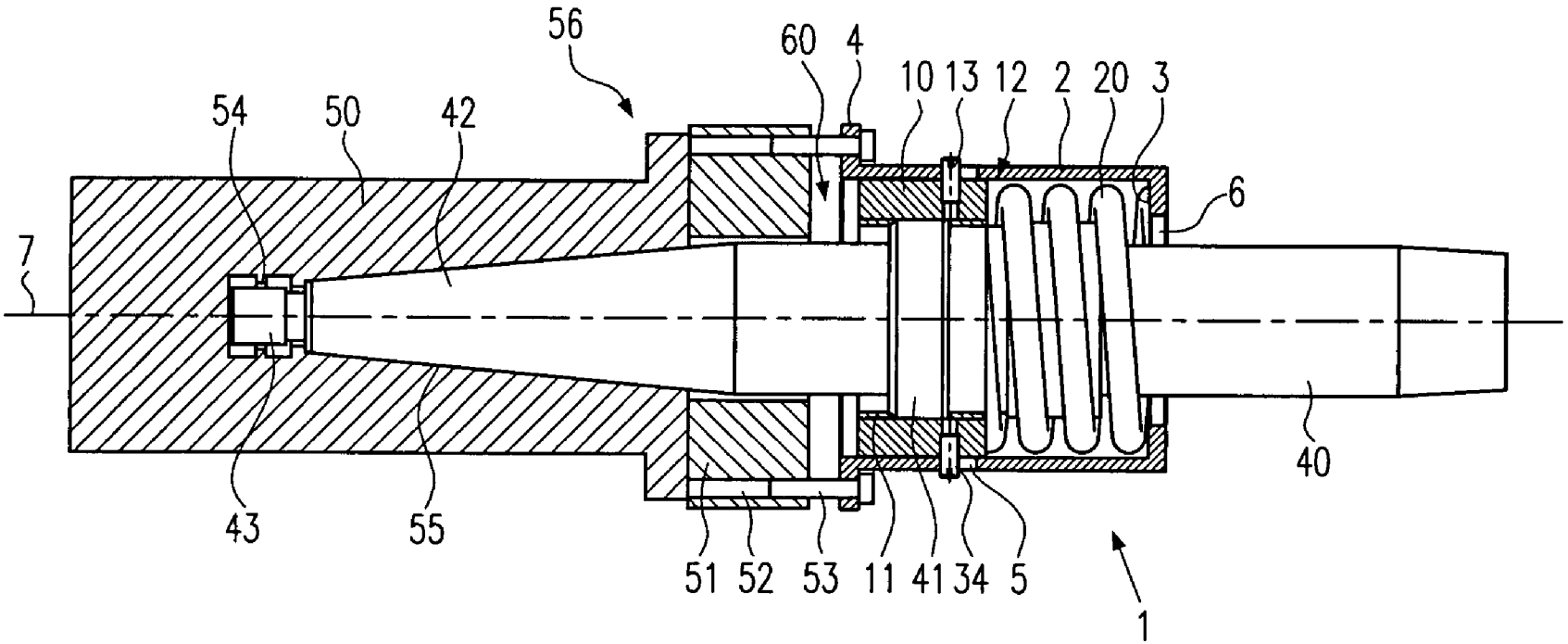
FIG. 1 shows a connection between a power cable and a mating connector with a first embodiment of a clamping device according to the invention, a straight power cable being used, FIG. 2 a second embodiment of a clamping device according to the invention in a situation as represented in FIG. 1, a bent power cable being used here, FIG. 3 an enlarged representation of the first embodiment of the clamping device of FIG. 1 without a power cable, FIG. 4 a third embodiment of a clamping device according to the invention with a safety switch, FIG. 5 a fourth embodiment of a clamping device according to the invention with a distance-measurement device and FIG. 6 a fifth embodiment of a clamping device according to the invention with a pressure sensor.

FIG. 1 shows a clamping device 1 according to the invention into which a power cable 40 is inserted, in a partial section. This is a straight standard power cable (unlike the bent standard power cable represented in FIG. 2). The power cable 40 is inserted into a mating connector 56. The mating connector 56 forms part of either a generator or an X-ray tube. In the following it is assumed that the mating connector 56 forms part of an X-ray tube (not represented). However, all versions apply equally in the case where the mating connector 56 is part of the generator. FIG. 1 is to be viewed in conjunction with FIG. 3, which shows an enlarged representation of just the clamping device 1, without the power cable 40 and mating connector 56.

The electric connection between mating connector 56 and power cable 40 is realized via a spring contact 54 at the mating connector 56 and a contact head 43 at the end of the power cable 40. The power cable 40 has a rubber cone 42, leading to the contact head 43, which is pressed into an inverted cone of an insulator 50 at the mating connector 56. These two parts must be pushed into each other in a precisely fitting and form-locking manner—the so-called junction is developed between them—in order that no high-voltage spark-overs occur inside the conical connection which could result in damage to or destruction of the power cable 40, the mating connector 50 or the X-ray tube. The junction 55 is also clad with a silicone layer. In order to achieve the form-locking, the power cable 40 is pressed in by means of screws 53, which are screwed into the screw thread 52 at the insulator flange 51. By tightening the screws 53, the gap 60 between the clamping device 1 and the mating connector 56 is reduced.

After the setting of the connection the form-locking connection between the rubber cone 42 of the power cable 40 and the inverted cone of the insulator 50 deteriorates over time because the natural rubber of the rubber cone 42 settles. In order to prevent this the represented clamping device 1 according to the invention is provided. It has a bell housing 2 which is developed essentially tubular. At its end facing the mating connector 56 the bell housing 2 has a circumferential flange 4 which defines an opening. At its opposite end the bell housing 2 has a stop 3 which defines a cable opening 6. The cable opening 6 is developed smaller than the opening on the mating connector side, because of the stop 3 defining it.

The flange 4 has at least one screw hole 8 (see FIG. 3), through which the clamping device 1, with the power cable 40 attached in it, is screwed to the insulator flange 51 of the mating connector 56. As a rule there are at least two, under certain circumstances even three to four or more, screw holes 8, in order that a good connection results.

A holding element 10 is arranged inside the tubular bell housing 2. The holding element 10 is also developed tubular and is arranged mobile along the central longitudinal axis 7 of the bell housing 2 at its inner wall 12. A helical spring 20 is arranged between the holding element 10 and the stop 3 of the bell housing 2. This is pre-tensioned to a high pressure (for example 1000 N). On the mating connector side the bell housing 2 and/or the holding element 10 are developed such that the helical spring 20, under a high initial tension, cannot force the holding element 10 out of the bell housing 2 (the actual elements are not represented, because they are not essential to the invention).

The internal surface of the holding element 10 has an internal thread 11 which engages with an external thread 41 of the power cable 40. The position of the power cable 40 can thus be changed in the direction of the central longitudinal axis 7 by a greater or lesser screwing of its external thread 41 into the internal thread 11 of the holding element 1. This helps to set the optimal connection between the power cable 40 and the mating connector 56.

In order to set this connection, the rubber cone 42 of the power cable 40 is pushed into the insulator 50 of the mating connector 56. By means of the screws 53, the gap 60 is reduced to the point where a form-locking connection between the rubber cone 42 and the inverted cone of the insulator 50 is realized, so that the junction 55 is completely closed.

When the screws 53 are tightened, from a certain position onwards the rubber cone 42 can no longer move further in the direction of the central longitudinal axis 7 into the mating connector 56. If the gap 60 is further reduced by tightening the screws 53, then the bell housing 2 travels, in relation to the now stationary holding element 10, in the direction of the insulator flange 51. The tension of the helical spring 20 is thereby further increased because it is compressed.

Two opposite headless screws 13 are arranged at the holding element 10 as display elements 34. Each of these protrudes through an opening 5 in the bell housing 2. When the gap 60 is reduced these headless screws 13 thus move from left to right. It is self-evident that only one headless screw 13, or more than two headless screws 13, each with associated openings 5, can also be provided in the bell housing 2. When the finished connection is in place, the headless screws 13 abut for example against the right-hand end of the opening 5 of the bell housing 2. Because the headless screws 13 are in indirect contact with the helical spring 20 via the holding element 10 and thus indicate its length, the spring force of the helical spring 20 can be inferred from the position of the headless screws 13.

The natural rubber of the rubber cone 42 settles over time, so that the helical spring 20 feels less counter pressure and increases in length. It thereby pushes the holding element 10, together with headless screws 13 located at it, from right to left in the direction of the left-hand end of the openings 5 in the bell housing 2. With the help of markings on the outer wall of the bell housing 2 in the area of the openings 5 the contact pressure of the power cable 40 in the mating connector 56 can thus be read off. If this pressure reaches a predeterminable lower limit, which can be the case for example if the headless screws 13 have reached the left-hand end of the openings 5, this is a signal that the connection must be expected to no longer be satisfactory, i.e. form-locking. In order to avoid any damage due to high-voltage spark-overs at the junction 55, a resetting of the connection is then required.

With the first embodiment according to the invention of a clamping device 1 a sure monitoring of the quality of the connection is thus ensured in a very simple manner. After the first installation, a resetting is necessary only in exceptional cases. The maintenance intervals are thereby kept very long, because resetting is to a certain extent automatic because of the spring pressure.

The connection represented in FIG. 2 differs in only a few details from the connection represented in FIG. 1, so that in the following only the differences compared with FIG. 1 are discussed. Identical components or those having the same function are given the same reference numbers.

The most striking difference is in the power cable 40 used. Unlike the straight standard power cable used in FIG. 1, a bent standard power cable is used here. The structure of the mating connector 56 is basically essentially the same, but there are differences in the specific design. However, because these are not essential to the invention, they are not discussed in the following.

The bell housing 2 of the clamping device 1 is designed identical to that represented in FIG. 1. However, the flange 4 at the end on the mating connector side could also be designed non-circumferential (it is exactly the same for the straight standard power cable represented in FIG. 1), but extend over only part of the circumference. In the extreme case, the screws 53 would then simply be passed through eyes. This makes sense if space is limited and the flange 4 is partly in the path. From the point of view of the mode of operation, however, this makes no difference as regards the represented circumferential flange 4.

Figure 4:
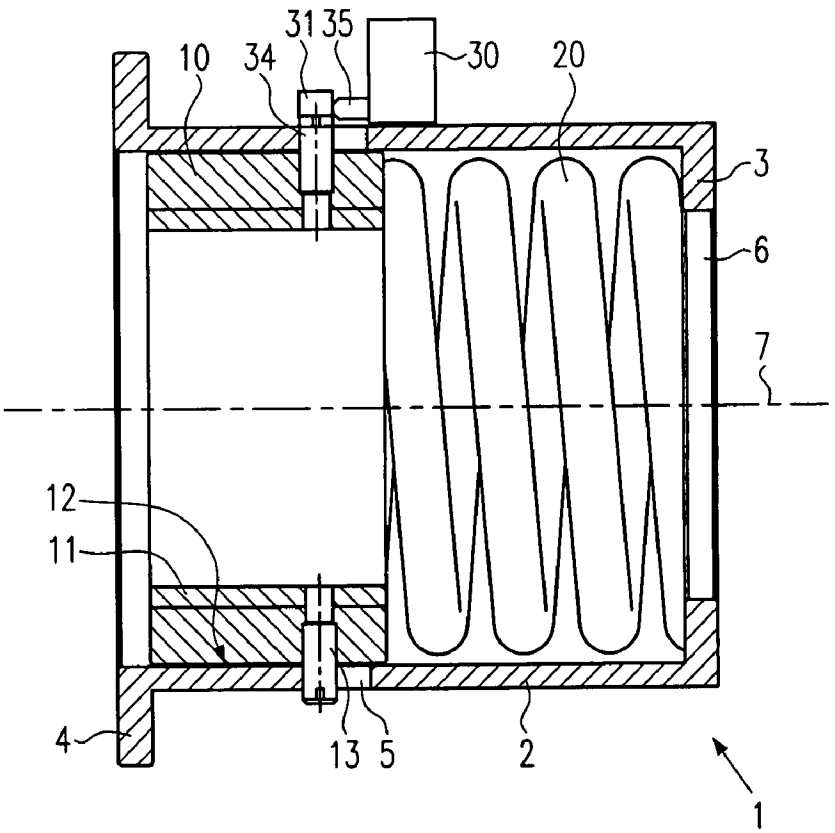
Figure 3:
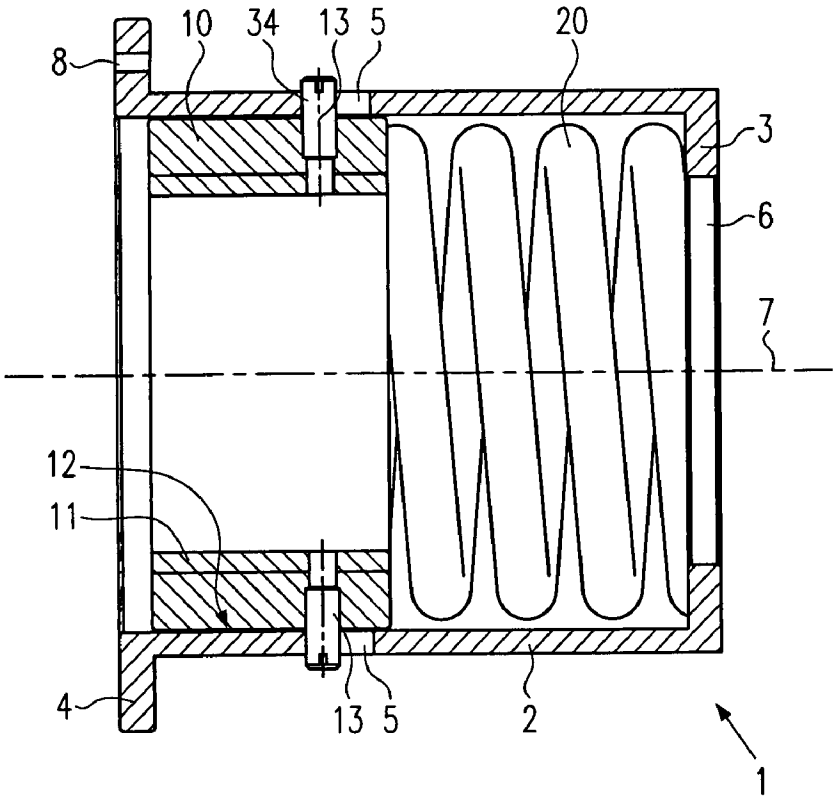

In FIG. 4 a third embodiment of a clamping device 1 according to the invention is represented. This differs from the first embodiment which is represented in FIGS. 1 and 3 only in the nature of the display elements 34 used. Therefore, in the following, only the differently developed display elements 34 are discussed.

One of the two headless screws 13 is extended, so that it has the form of an actuating pin 31, which projects a little beyond the surface of the bell housing 2. The actuating pin 31 cooperates with a safety switch 30 arranged at the outer surface of the bell housing 2 adjoining the right-hand end of the opening 2. The actuating pin 31 operates a detent pin 35.

When the connection is freshly set, the actuating pin 31 is located at the right-hand end of the opening 5, so that the release pin 35 is fully pressed into the safety switch 30. If the rubber of the rubber cone 42 settles, the helical spring 20 pushes the actuating pin 31 in the direction of the left-hand end of the opening 5. The release pin 35 follows it by means of suitable elements (which are not essential to the invention). If the distance between the actuating pin 31 and the safety switch 30 is so large that a previously definable value is exceeded, an electric signal is triggered by the interaction of the detent pin 35 with the safety switch 30. This is passed for example via an electric line to a monitor (neither are shown), so that the operator of the X-ray tube notices this immediately. It is equally possible that, as long as the detent pin 35 maintains contact, a safety circuit is closed which is opened as soon as the contact is broken. This then leads to an immediate cut-off of the high-voltage at the X-ray tube in order to prevent damage to individual parts or the whole installation.

Figure 2:
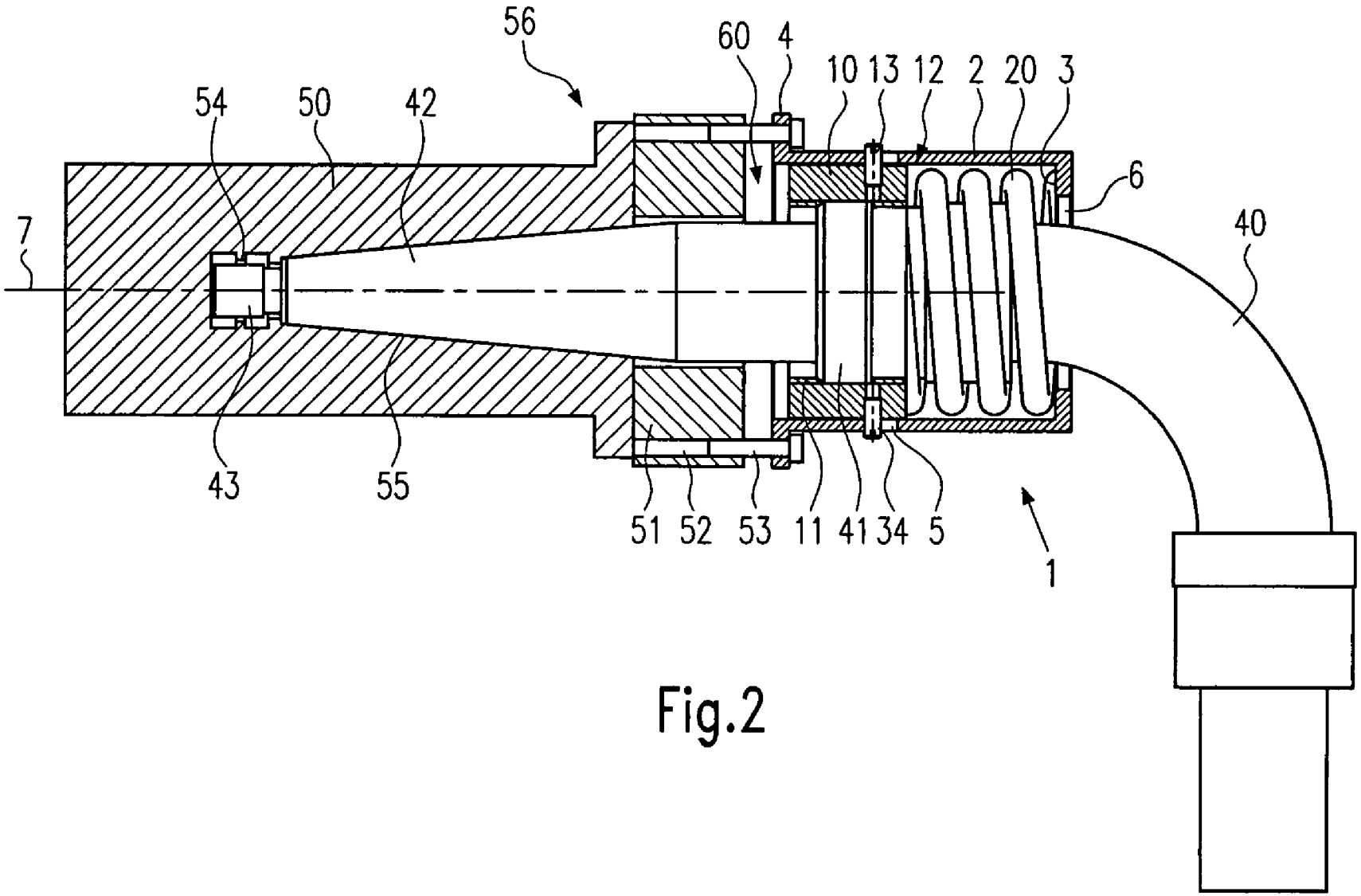

Another possibility is also that, when the safety switch 30 is triggered, the generator is immediately shut off, so that damage due to high-voltage spark-overs inside the junction 55 can in no case occur (see FIGS. 1 and 2). The life of the entire installation, i.e. of the X-ray tube and of the power cable 40 and the generator, is thereby prolonged. In addition, the maintenance interval is also optimized, because only when the predeterminable pressure of the helical spring 20 is not reached is the safety switch 30 triggered and until then a frictionless operation of the unit is ensured.

It is equally possible to position the safety switch 30 in the area of the left-hand end of the opening 5 on the bell housing 2. The safety switch 30 must then be designed such that when the detent pin 35 is pushed in by the actuating pin 31 triggering takes place from a certain degree of insertion onwards.

Figure 5:
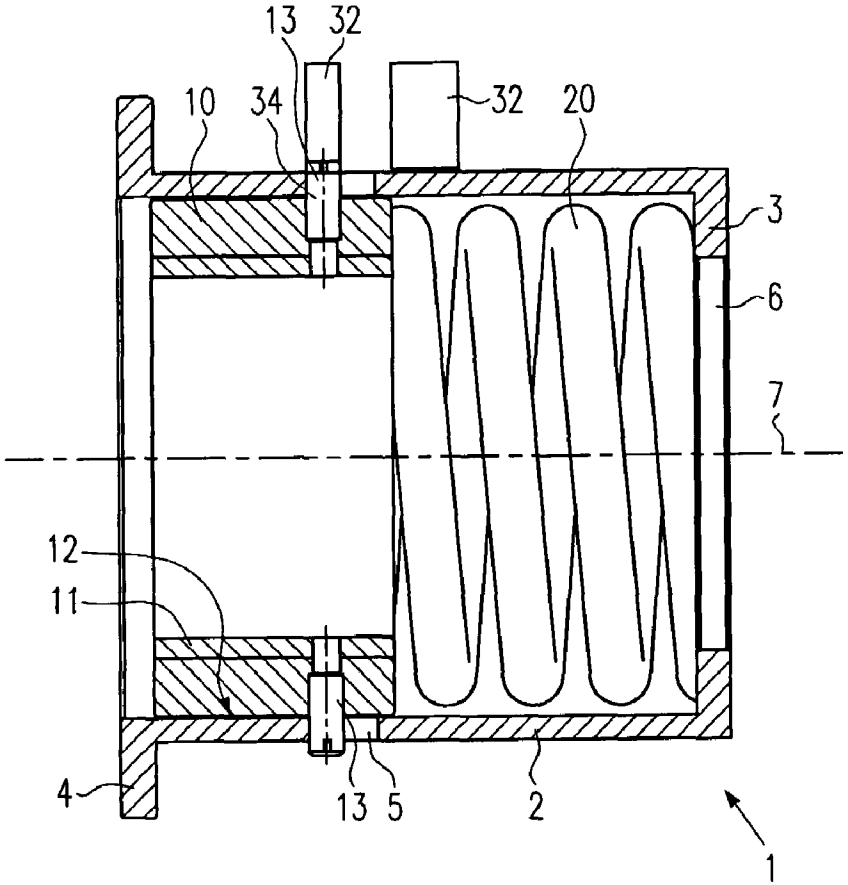

The fourth embodiment, represented in FIG. 5, of a clamping device 1 according to the invention differs from that represented in FIG. 4 only in that, instead of a safety switch 30 with associated elements, a distance-measurement device 32 is used. The distance is measured by known methods and devices, which are not essential to the invention and therefore will not be described in more detail.

If the rubber of the rubber cone 42 settles, the mobile part, designed as a display element 41, of the distance-measurement device 32 moves to the left so that the distance from the fixed part, attached to the outer surface of the bell housing 2, of the distance-measurement device 32 is increased. If this distance exceeds a predeterminable value—which corresponds to failing to reach an associated tension value of the helical spring 20—an electric signal is triggered and the same actions as described for FIG. 4 are triggered.

In addition to the triggering of an alarm when a certain distance is exceeded—as in the case represented—the alarm can also be triggered when a predeterminable distance is not reached. The fixed part of the distance-measurement device 32 need not be positioned to the right of the opening 5, but to the left of the opening 5. Basically this is to be considered in exactly the same way as the embodiment represented in FIG. 4.

Figure 6:
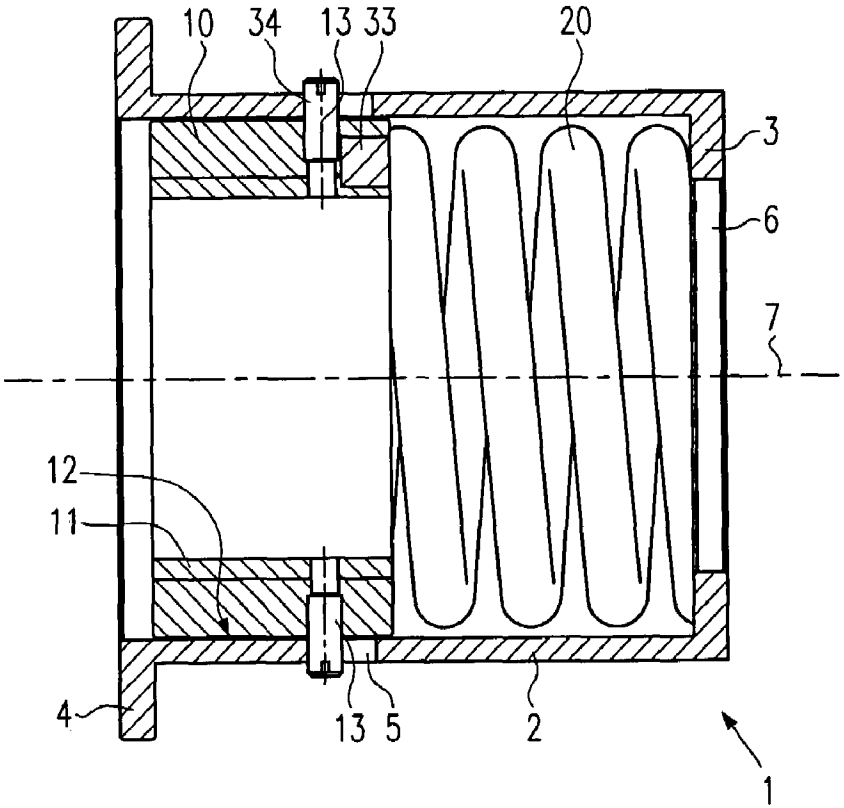

In FIG. 6, within the framework of a fifth embodiment of a clamping device 1 according to the invention, in addition to the headless screws 13 a pressure sensor 33 is represented as a display element 34. The pressure sensor 33 is arranged in the end-wall of the holding element 10 which lies opposite the stop 3. Thus the helical spring 20 acts directly on the pressure sensor 33 and ensures a reliable determination of the pressure of the helical spring 20. As the pressure of the helical spring 20 is a measure of the quality of the connection (see description relating to FIG. 1), an action named in relation to the above-mentioned embodiments can take place when a predeterminable pressure is not reached. For example, the drop in pressure below a predeterminable limit value is displayed to the operator on a monitor or the generator automatically cuts out.

In the case of the three embodiments represented in FIGS. 4 to 6, in addition to the display elements 34 in the form of sensors (safety switch 30, distance-measurement device 32 and pressure sensor 33), the possibility of optical monitoring via the headless screws 13 is also guaranteed. This provides an additional safeguard should one or the other sensor fail. It is self-evident that the headless screws 13 represented are only optional and the invention is already realized by the respective sensor. It is also clear to a person skilled in the art that a combination of two or more of the above-mentioned sensors is also possible. This further improves reliability and safety, so that the risk of damage to the unit can be further reduced.

By using sensors it is also possible to extrapolate the measured values between the defined maintenance dates and thus produce diagrams which give information about the settling behaviour of the rubber cone 42 or the overall behaviour of the connection.

In summary, the clamping device 1 according to the invention minimizes the outlay involved in the installation and maintenance of a power cable 40. Although the condition of the cable still needs to be monitored, a replacement of the cable is necessary only in response to a corresponding display. The maintenance intervals when using a clamping device 1 according to the invention are very long, as resetting is automatic because of the spring pressure. Within a predeterminable (long) maintenance interval a resetting is required only if the optical display or the sensors indicate this. Important information about the state of the high-voltage connection can also be obtained without opening same, and can also be made available to the operator of the unit and to a service technician. This information can also be made available to the whole X-ray system, further processing being able to take place here. This is important for example for diagnosis and protective measures, so that an automatic cut-out occurs when a predetermined limit value for the spring tension is reached or the position of the display element 34 is set. As a result, the number of repairs to be carried out after high-voltage spark-overs on the junction 55 can thereby be minimized.

What is claimed:

1. A clamping device for power cables comprising:

a substantially tubular bell housing having a tubular holding element translationally arranged along the central longitudinal axis of the bell housing for receiving a power cable, the holding element comprising fixing means for the fixed releasable securing of a power cable;

a spring between a stop in the bell housing and the holding element to bias the holding element away from the stop along the central longitudinal axis; and a display element arranged at the holding element, so that a state of the spring perceptible, wherein the spring surrounds the power cable.

2. A clamping device according to claim 1, wherein the display element comprises at least one headless screw disposed in an opening of the bell housing running parallel to the central longitudinal axis of the bell housing.

3. A clamping device according to claim 1, wherein the display element is one of an electric, magnetic or pressure sensor that records the position of the holding element inside the bell housing.

4. A clamping device according to claim 3, wherein the pressure sensor is integrated into the holding element and is arranged at a surface in contact with the spring.

5. A clamping device according to claim 1, wherein the display element cooperates with one of a safety switch or a distance-measurement device.

6. A clamping device according to claim 1, wherein the fixing means comprises a threaded bushing with an internal thread.

7. A clamping device according to claim 1, wherein a power cable is inserted into the holding element.

8. A clamping device according to claim 7, wherein the power cable comprises securing means for connecting to the fixing means of the holding element.

9. A clamping device according to claim 8, wherein the securing means comprises an external thread.

10. A clamping device according to claim 1, wherein the bell housing comprises a circumferential flange on a connection side comprising at least two screw holes parallel to the central longitudinal axis of the bell housing.

* * * * *